US011407552B2

(12) United States Patent
Peng

(10) Patent No.: US 11,407,552 B2
(45) Date of Patent: Aug. 9, 2022

(54) ACCOMMODATION STRUCTURE AND APPARATUS KIT

(71) Applicant: GUANGDONG OPPO MOBILE TELECOMMUNICATIONS CORP., LTD., Guangdong (CN)

(72) Inventor: Can Peng, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 17/242,183

(22) Filed: Apr. 27, 2021

(65) Prior Publication Data

US 2021/0245916 A1 Aug. 12, 2021

Related U.S. Application Data

(63) Continuation of application No. PCT/CN2019/107442, filed on Sep. 24, 2019.

(30) Foreign Application Priority Data

Oct. 29, 2018 (CN) ..... 201821767662.1

(51) Int. Cl.
*B65D 5/50* (2006.01)
*B65D 5/38* (2006.01)
*B65D 5/66* (2006.01)

(52) U.S. Cl.
CPC ..... *B65D 5/503* (2013.01); *B65D 5/38* (2013.01); *B65D 5/6629* (2013.01)

(58) Field of Classification Search
CPC .. B65D 81/113; B65D 5/0085; B65D 77/006; B65D 5/0227; B65D 5/5253;
(Continued)

(56) References Cited

U.S. PATENT DOCUMENTS 292,654 A * 1/1884 Jaeger ..... B65D 5/6638 229/149
611,063 A * 9/1898 Davis ..... B65D 5/5253 5/2.1

(Continued)

FOREIGN PATENT DOCUMENTS

CN 202175336 U 3/2012
CN 202784122 U 3/2013

(Continued)

OTHER PUBLICATIONS

ISR with English Translation for PCT application PCTCN2019107442 dated Dec. 31, 2019.

(Continued)

*Primary Examiner* — King M Chu
*Assistant Examiner* — Prince Pal
(74) *Attorney, Agent, or Firm* — Young Basile Hanlon & MacFarlane, P.C.

(57) ABSTRACT

An accommodation structure and an apparatus kit are provided. The accommodation structure is configured for receiving a mobile terminal. The accommodation structure includes a base. The base is provided with a groove, the groove has a bottom provided with an accommodating slot for receiving the mobile terminal, and the groove has a depth increasing from an edge of the groove to a position where the accommodating slot is located. The accommodating slot has a depth varying along a periphery of the accommodating slot, and the depth of the accommodating slot has a minimum value at a position of a maximum depth of the groove.

18 Claims, 5 Drawing Sheets

(58) Field of Classification Search
CPC .... B65D 5/6638; B65D 5/503; B65D 5/6629; B65D 5/38; B65D 77/042; B65D 43/26; B65D 285/6835; B65D 81/07; B65D 81/075; B65D 5/5038; A45C 2011/003; A45C 2011/002; A45C 2011/001; A45C 11/00; A47F 7/708
USPC ..... 206/320, 235, 823, 223, 747, 748, 745, 206/749, 308.3, 755, 583; 190/109, 119
See application file for complete search history.

(56) References Cited

U.S. PATENT DOCUMENTS 1,600,830 A * 9/1926 Lewis ..... A45C 5/005 190/110
1,980,683 A * 11/1934 Herrmann ..... A45C 11/24 206/823
1,988,280 A * 1/1935 Levkoff ..... B65D 5/5253 229/149
D135,707 S * 5/1943 Drueke, Jr. ..... D21/341
2,387,790 A * 10/1945 Williamson ..... B65D 5/48 206/750
3,058,579 A * 10/1962 Morin ..... A61B 50/312 220/520
3,463,309 A * 8/1969 Szostek ..... B65D 75/322 206/470
3,853,220 A * 12/1974 Luray ..... B65D 81/075 206/466
3,886,901 A * 6/1975 Zeitter ..... A01K 1/0125 229/101
3,902,598 A * 9/1975 Koob ..... B65D 85/00 220/4.23
4,134,497 A * 1/1979 Dlugopolski ..... B65D 5/5038 206/521
4,485,926 A * 12/1984 Lenzmeier ..... B65D 5/009 229/120.011
5,294,043 A * 3/1994 Platt ..... B65D 5/6629 229/128
5,385,238 A * 1/1995 Lancaster ..... B65D 5/5042 206/591
5,941,255 A * 8/1999 Chen ..... A45D 29/20 206/823
6,065,596 A * 5/2000 Cavanagh ..... A61B 50/20 206/363
7,878,326 B2 * 2/2011 Andre ..... B65D 77/20 206/320
9,131,757 B2 * 9/2015 Tseng ..... B65D 5/5273
9,238,523 B1 * 1/2016 Frost ..... B65D 5/505
D805,398 S * 12/2017 Torchin ..... D9/737
D830,821 S * 10/2018 Torchin ..... D9/414
11,124,345 B1 * 9/2021 Hockin ..... B65D 77/26
2003/0127347 A1 * 7/2003 Carlucci ..... A45D 44/02 206/823
2004/0140243 A1 * 7/2004 Roesel ..... B65D 81/075 206/583
2005/0023161 A1 * 2/2005 Hsu ..... B65D 5/4801 206/320
2006/0266672 A1 * 11/2006 Young ..... B65D 77/0433 206/776
2007/0017848 A1 * 1/2007 Sasaki ..... A45D 33/20 206/823
2008/0093233 A1 * 4/2008 Jones ..... B65D 77/042 206/268
2008/0173557 A1 * 7/2008 Chou ..... A45D 33/22 206/308.1
2008/0272021 A1 * 11/2008 Cavazza ..... B65D 5/427 206/459.5
2009/0173659 A1 * 7/2009 Li ..... B65D 5/5004 206/588
2014/0262863 A1 * 9/2014 Fournier ..... B65D 85/70 206/223
2015/0060310 A1 * 3/2015 Tseng ..... B65D 5/5213 206/45.23
2016/0297596 A1 * 10/2016 Yamashita ..... B65D 5/5028
2016/0325908 A1 * 11/2016 Hsu ..... B65D 81/058
2017/0247135 A1 * 8/2017 Longberg ..... B65D 5/5028
2017/0349350 A1 * 12/2017 Lee ..... B65D 5/325
2018/0290787 A1 * 10/2018 McDonald ..... B65D 5/3614
2021/0354872 A1 * 11/2021 Ling ..... B65D 50/046

FOREIGN PATENT DOCUMENTS

CN 203997526 U 12/2014
CN 204642553 U 9/2015
CN 205131915 U 4/2016
CN 106428882 A 2/2017
CN 206297932 U 7/2017
CN 209321455 U 8/2019
KR 200369591 Y1 12/2004
KR 20130039083 A 4/2013
WO 2015088744 A1 6/2015

OTHER PUBLICATIONS

Extended European Search Report for EP Application 19879210.3 dated Nov. 18, 2021. (7 pages).

* cited by examiner

ACCOMMODATION STRUCTURE AND APPARATUS KIT

CROSS-REFERENCE TO RELATED APPLICATION(S)

This application is a continuation of International Patent Application No. PCT/CN2019/107442, filed on Sep. 24, 2019, which claims priority to Chinese Application No. 201821767662.1, filed on Oct. 29, 2018, the entire contents of both of which are incorporated herein by reference.

TECHNICAL FIELD

The present disclosure relates to a technical field of accommodation structures for electronic products, and more particularly, to an accommodation structure and an apparatus kit.

BACKGROUND

After purchasing a mobile phone, a user needs to take the mobile phone out of a mobile phone box. When taking the mobile phone from an existing mobile phone box, it is often necessary to turn the mobile phone box over, i.e. upside down, so as to separate the mobile phone from the mobile phone box, which brings inconvenience to the user.

SUMMARY

On this basis, it is necessary to provide an accommodation structure and an apparatus kit.

Embodiments of a first aspect of the present disclosure provide an accommodation structure. The accommodation structure is configured for receiving a mobile terminal. The accommodation structure includes a base. The base is provided with a groove, the groove has a bottom provided with an accommodating slot for receiving the mobile terminal, and the groove has a depth increasing from an edge of the groove to a position where the accommodating slot is located. The accommodating slot has a depth varying along a periphery of the accommodating slot, and the depth of the accommodating slot has a minimum value at a position of a maximum depth of the groove.

Embodiments of a second aspect of the present disclosure provide an apparatus kit. The apparatus kit includes a mobile terminal and an accommodation structure. The accommodation structure includes a base, and the mobile terminal is arranged in the base. The base has a groove, the groove is provided with an accommodating slot in a bottom thereof, the mobile terminal is received in the accommodating slot, the groove has a depth increasing from an edge of the groove to a position where the accommodating slot is located, and a peripheral part of the mobile terminal protrudes out of the accommodating slot at a position of a maximum depth of the groove.

Embodiments of a third aspect of the present disclosure provide an accommodation structure for receiving a mobile terminal. The accommodation structure includes a base. The base has a surface, the surface has a concave part recessed relative to rest of the surface, and an accommodating slot is formed in the concave part and configured to receive the mobile terminal. The concave part has a depth increasing from the rest of the surface to a peripheral wall of the accommodating slot, the peripheral wall of the accommodating slot has a varying height, and the peripheral wall of the accommodating slot has a minimum height at a position where the concave part has a maximum depth.

BRIEF DESCRIPTION OF DRAWINGS

In order to more clearly describe embodiments of the present disclosure or technical solutions in the related art, a brief introduction of drawings used in the embodiments or the description of the related art will be made below. Obviously, the drawings described below are merely some embodiments of the present disclosure, and those skilled in the related art can obtain the drawings of other embodiments according to these drawings without making creative efforts.

DETAILED DESCRIPTION

In order to facilitate the understanding of the present disclosure, a more comprehensive description of the present disclosure will be given below with reference to the accompanying drawings. An illustrative embodiment of the present disclosure is illustrated in the accompanying drawings. However, the present disclosure may be implemented in many different forms and is not limited to the embodiments described herein. On the contrary, these embodiments are provided for a more thorough and comprehensive understanding of the content of the present disclosure.

The term "terminal device" used herein refers to a device capable of receiving and/or transmitting communication signals, including but not limited to devices connected via any one of or a plurality of following connection manners:

(1) via a wired line connection manner, such as via connections of a public switched telephone networks (PSTN), a digital subscriber line (DSL), a digital cable, and a direct cable;

(2) via a wireless interface manner, such as a cellular network, a wireless local area network (WLAN), a digital TV network such as DVB-H network, a satellite network, and an AM-FM broadcast transmitter.

A terminal device configured to communicate through a wireless interface may be referred to as a "mobile terminal". Examples of the mobile terminal include, but are not limited to, the following electronic devices:

(1) a satellite telephone or a cellular telephone;

(2) a personal communications system (PCS) terminal that can combine a cellular radiophone with capabilities of data processing, faxing and data communication;

(3) a radiophone, a pager, an internet/intranet access, a web browser, a notepad, a calendar, a personal digital assistant (PDA) equipped with a global positioning system (GPS) receiver;

(4) a conventional laptop and/or palmtop receiver;

(5) a conventional laptop and/or palmtop radiophone transceiver, etc.

Figure 1:
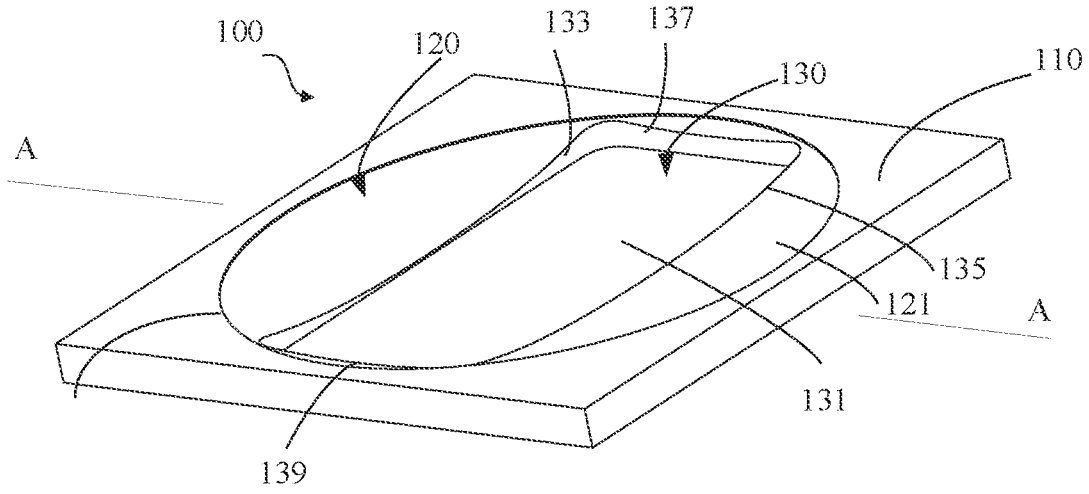
FIG. 1 is a schematic view of a base of an accommodation structure in a state according to an embodiment of the present disclosure.
Figure 2:
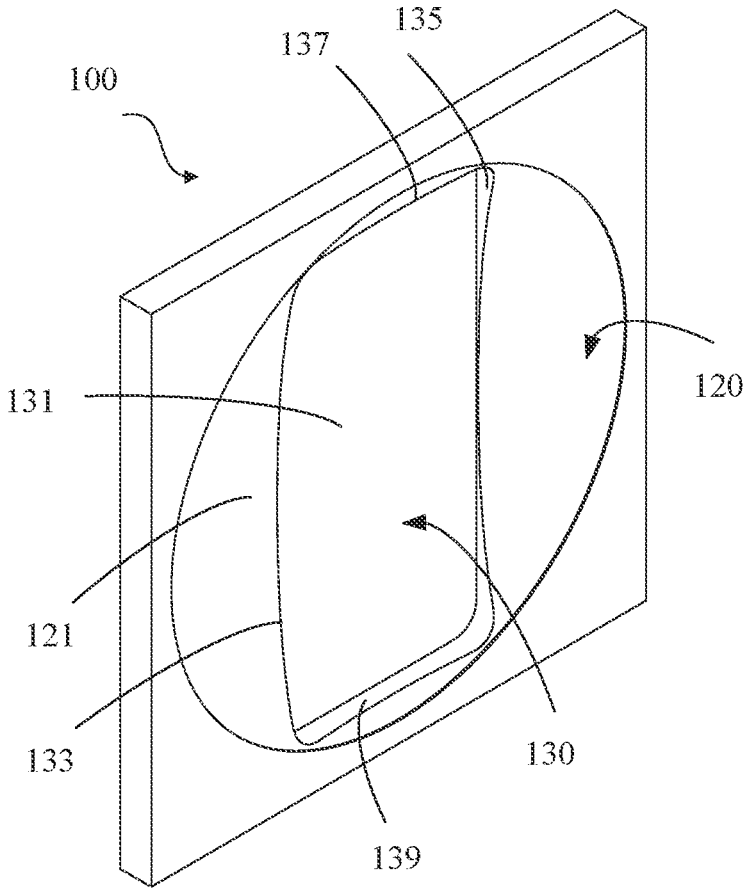
FIG. 2 is a schematic view of the base illustrated in FIG. 1 in another state.
Figure 3:
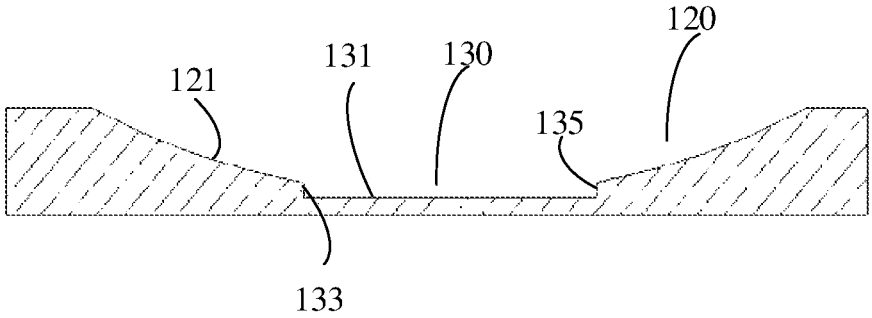
FIG. 3 is a schematic view illustrating a section of the base illustrated in FIG. 1, the section being taken at a line A-A.
Figure 4:
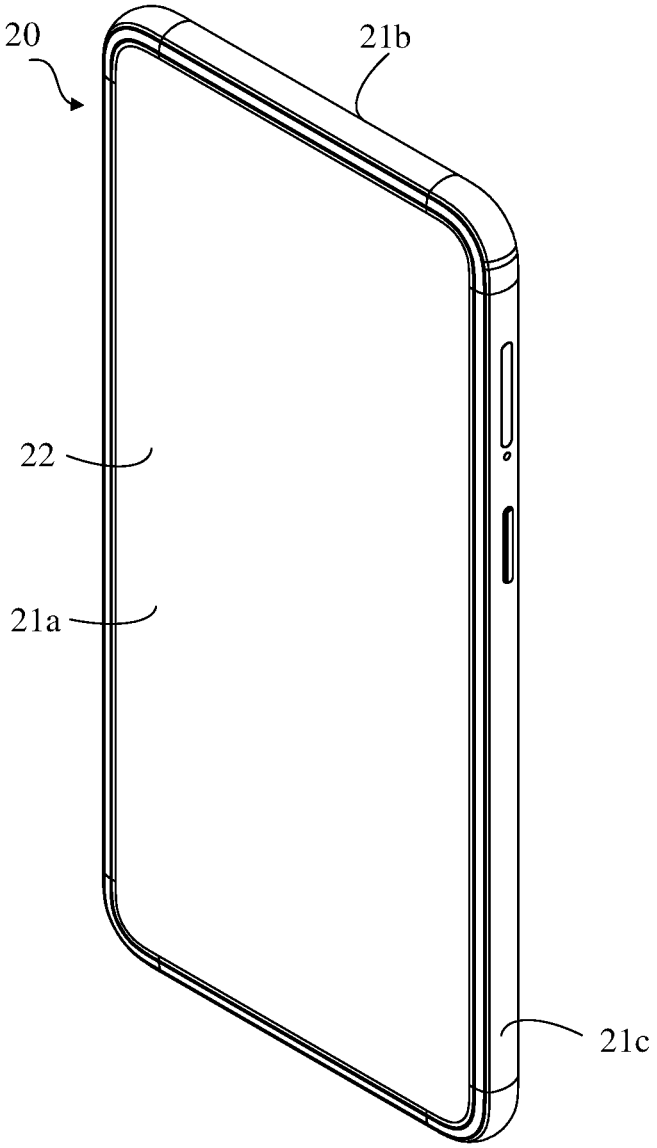
FIG. 4 is a perspective view of a mobile terminal according to an embodiment of the present disclosure.
Figure 5:
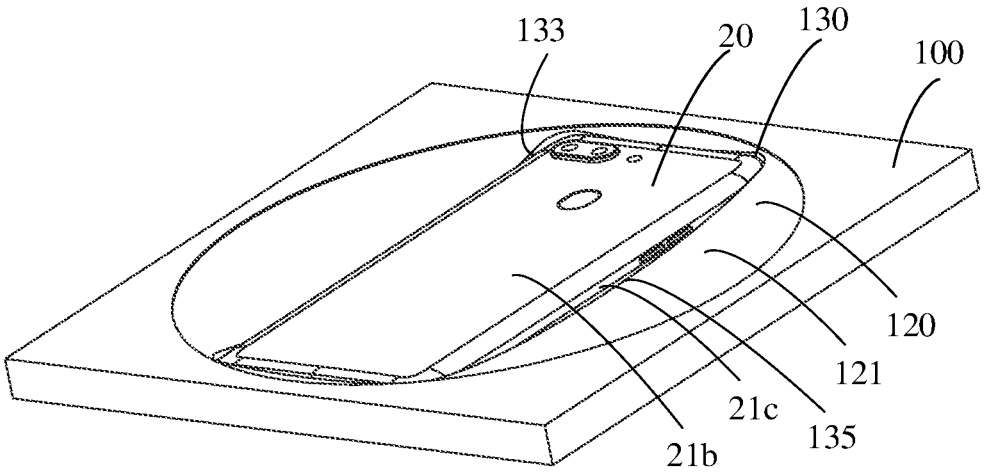
FIG. 5 is a schematic view of the base illustrated in FIG. 1 after a mobile terminal is arranged therein.

The present disclosure provides accommodation structures for accommodating terminal devices. As illustrated in FIGS. 1 to 3, the accommodation structure can include a base 100. The base 100 is configured for receiving a mobile terminal 20, such as a mobile phone, etc. As also illustrated in FIG. 4, in an embodiment, the mobile terminal 20 is substantially in a rectangular block shape, and the mobile terminal 20 includes a front surface 21*a* and a rear surface 21*b* facing away from each other, and a side peripheral surface 21*c* connected between the front surface 21*a* and the rear surface 21*b*. The mobile terminal 20 includes a display screen 22, which may be configured to display information and provide an interactive interface for a user, and a display area of the display screen 22 faces the front surface 21*a*. As illustrated in FIG. 1 and FIG. 2, the base 100 has a surface 110, the surface 110 is provided with a groove 120, a bottom 121 of the groove 120 is provided with an accommodating slot 130 for receiving the mobile terminal 20, and a depth of the groove 120 gradually increases from an edge of the groove 120 to a position where the accommodating slot 130 is located. As also illustrated in FIG. 5, when the mobile terminal 20 is arranged in the accommodating slot 130, a part of the side peripheral surface 21*c* is exposed out of the accommodating slot 130 at a position of a maximum depth of the groove 120. The side peripheral surface 21*c* exposed out of the accommodating slot 130 may serve as a force bearing point, such that the user's fingers can grip the side peripheral surface 21*c* of the mobile terminal 20 and take the mobile terminal 20 out of the base without turning over the base 100.

In the embodiment illustrated in FIG. 1 and FIG. 2, the depth of the groove 120 may be understood as follows: a depth of a certain point of the bottom 121 of the groove 120 refers to a vertical distance between the point and a plane where the edge of the groove 120 is located. By forming the groove 120 in the base 100, and then forming the accommodating slot 130 in the bottom 121 of the groove 120, the depth of the groove 120 gradually increases from the edge of the groove 120 to the position where the accommodating slot 130 is located, and the depth of the accommodating slot 130 is the shallowest at the maximum depth of the groove 120. After the mobile terminal 20 is arranged in the accommodating slot 130, the part of the side peripheral surface 21*c* of the mobile terminal 20 is exposed out of the accommodating slot 130, and the user can extend his/her fingers into the groove 120 and place the fingers on both sides of the accommodating slot 130, so as to grip and take out the mobile terminal 20 in the accommodating slot 130 through the side peripheral surface 21*c* of the mobile terminal 20, thus improving the convenience of use.

As illustrated in FIG. 2 and FIG. 3, the accommodating slot 130 is in a rectangular slot shape, and a size of a cross section of the accommodating slot 130 is substantially equal to a size of a cross section of the mobile terminal 20. For example, the size of the cross section of the accommodating slot 130 may be slightly larger than the size of the cross section of the mobile terminal 20, or the size of the cross section of the accommodating slot 130 may be slightly smaller than the size of the cross section of the mobile terminal 20. The accommodating slot 130 is defined by a bottom wall 131 and a side wall arranged in a circumferential direction of the bottom wall 131. The side wall includes a first side wall 133 and a second side wall 135 arranged opposite to each other, as well as a third side wall 137 and a fourth side wall 139 connected between the first side wall 133 and the second side wall 135. The third side wall 137 and the fourth side wall 139 are arranged opposite to each other. The first side wall 133, the second side wall 135, the third side wall 137, the fourth side wall 139 and the bottom wall 131 define the accommodating slot 130. A maximum distance between the first side wall 133 and the second side wall 135 is less than a maximum distance between the third side wall 137 and the fourth side wall 139, that is, the first side wall 133 and the second side wall 135 correspond to two long sides of the rectangular slot, respectively, and the third side wall 137 and the fourth side wall 139 correspond to two short sides of the rectangular slot, respectively. As illustrated in FIG. 5, when the mobile terminal 20 is arranged in the accommodating slot 130, the part of the side peripheral surface 21*c* is exposed out of the first side wall 133 and the second side wall 135. The bottom wall 131 may be in a planar shape such that the mobile terminal 20 may be arranged flat in the accommodating slot 130. Furthermore, a plane where the bottom wall 131 is located may be parallel to the plane where the edge of the groove 120 is located, such that when the mobile terminal 20 can be arranged flat in the accommodating slot 130, the front surface 21*a* of the mobile terminal 20 is parallel to the plane where the edge of the groove 120 is located. Through the above arrangements, the mobile terminal 20 can be stably arranged in the accommodating slot 130, and also the mobile terminal 20 can be easily taken out of the base 100.

In an embodiment, a geometric plane perpendicular to a depth direction of the groove 120 is provided to serve as a reference plane. An orthographic projection of the groove 120 on the reference plane is a circle, and an orthographic projection of the accommodating slot 130 on the reference plane is a rectangle. For example, the reference plane may be a plane where the surface 110 of the base 100 is, the orthographic projection of the groove 120 on the plane of the surface 110 is a circle, and the orthographic projection of the accommodating slot 130 on the plane of the surface 110 is a rectangle, as shown in FIGS. 1, 2, 8 and 9. The groove 120 of the above structure has the maximum depth at a center position thereof. Since the bottom 121 of the groove 120 is provided with the rectangular accommodating slot 130, the groove 120 has the maximum depth and the accommodating slot 130 has the shallowest depth at centers of orthographic projections of the first side wall 133 and the second side wall 135. The above structure may also be interpreted as a meaning that the accommodating slot 130 has the shallowest depth at middle positions of the first side wall 133 and the second side wall 135. After the mobile terminal 20 is arranged in the accommodating slot 130, the side peripheral surface 21*c* of the mobile terminal 20 is exposed out of the accommodating slot 130 at the middle positions of the first side wall 133 and the second side wall 135. Furthermore, in an embodiment, at the position of the maximum depth of the groove 120, a thickness of a part of the mobile terminal 20 exposed out of the accommodating slot 130 is greater than or equal to ½ of a thickness of the mobile terminal 20. Through ensuring a sufficient thickness of the part of the mobile terminal 20 exposed out at the middle positions of the first side wall 133 and the second side wall 135, it is convenient for the user to grip and move the mobile terminal 20, such that the mobile terminal 20 can be taken out from the accommodating slot 130. Furthermore, the thickness of the part of the mobile terminal 20 exposed out of the accommodating slot 130 is greater than or equal to ⅘ of the thickness of the mobile terminal 20, which further facilitates the mobile terminal 20 to be taken out from the accommodating slot 130. In other embodiments, the orthographic projection of the groove 120 on the reference plane may be a regular N-polygon, and N is an integer greater than or equal to 3. For example, the orthographic projection of the groove 120 may be a regular triangle, a regular quadrilateral, a regular pentagon, a regular hexagon, or the like.

In an embodiment, an orthographic projection of the base 100 on the reference plane is in a rectangular shape. That is, the base 100 is substantially in a rectangular block shape, and the rectangular shape may be a rectangle or a square. An edge of the base 100 surrounds the groove 120, such that the groove 120 does not run through the edge of the base 100, so as to improve an appearance integrity of the base 100. Furthermore, in an embodiment, a center of the orthographic projection of the groove 120 on the reference plane, a center of the orthographic projection of the accommodating slot 130 on the reference plane and a center of the orthographic projection of the base 100 on the reference plane coincide with one another. The above arrangement enables the base 100 to be highly symmetrical, such that the base 100 is more concise and aesthetical. Furthermore, in an embodiment, the bottom 121 of the groove 120 is a spherical surface. For example, the bottom 121 of the groove 120 may be a part of a spherical surface of an ellipsoid or a spherical surface of a sphere. As such, the base 100 is more aesthetical and it is more convenient for the user to place his/her fingers on both sides of the accommodating slot 130 to grip the mobile phone. In this embodiment, the bottom 121 of the groove 120 is a part of the spherical surface of the sphere, such that a curvature of the bottom 121 of the groove 120 is the same everywhere, which facilitates the manufacture of the base 100 and enables the base 100 to be more aesthetical.

Figure 6:
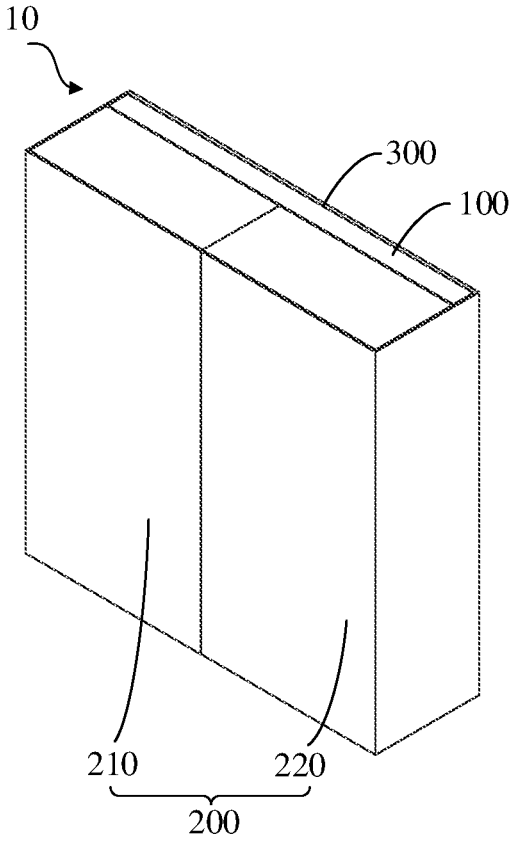
FIG. 6 is a schematic view of a package box in a closed state according to an embodiment of the present embodiment.
Figure 7:
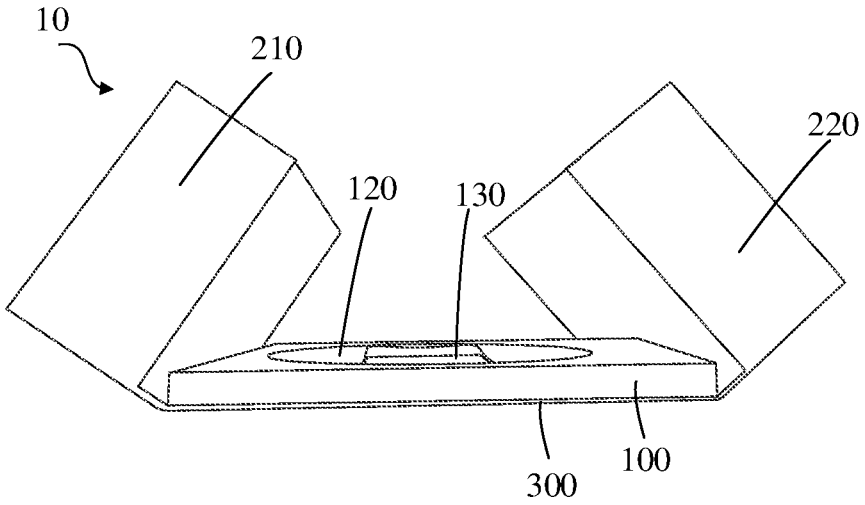
FIG. 7 is a schematic view of the package box illustrated in FIG. 6 in an open state.
Figure 8:
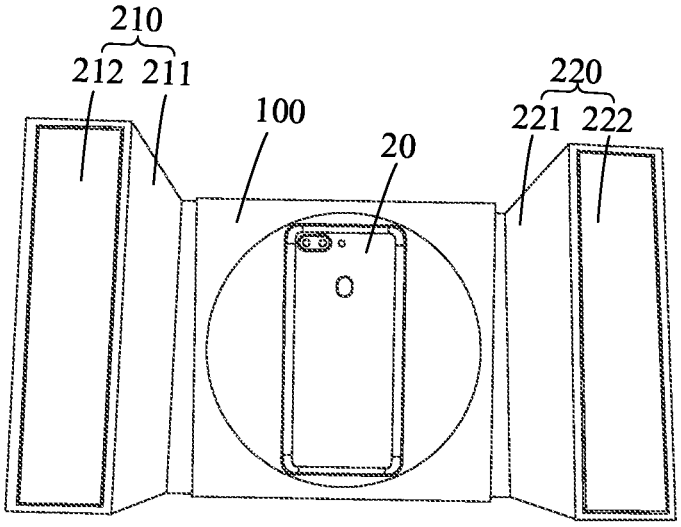
FIG. 8 is a schematic view of the package box illustrated in FIG. 6 in the open state after a mobile terminal is arranged in the package box.

As illustrated in FIG. 6 to FIG. 8, the accommodation structure can include a cover body 200 and the base 100, and the cover body 200 and the base 100 cooperatively define a package box 10. The cover body 200 is rotatably connected with a side of the base 100 such that the cover body 200 is able to cover the accommodating slot 130. In this way, the accommodating slot 130 may be covered or opened by rotating the cover body 200. When the mobile terminal 20 is to be arranged, the cover body 200 is rotated to expose the accommodating slot 130. In this case, the package box 10 is in an open state, and the mobile terminal 20 is placed in the accommodating slot 130. Then, the cover body 200 is rotated to cover the accommodating slot 130. In this case, the package box 10 is in a closed state, such that the mobile terminal 20 can be stably stored in the package box 10. When the mobile terminal 20 needs to be taken out, the cover body 200 is rotated to open the package box 10, such that it is convenient to take the mobile terminal 20 out from the package box 10. Through the above arrangement, the package box 10 in the present disclosure is convenient to use.

As illustrated in FIG. 6, when the cover body 200 covers the accommodating slot 130, an orthographic projection of the cover body 200 on the reference plane coincides with the orthographic projection of the base 100 on the reference plane. That is, when the package box 10 is in the closed state, the cover body 200 completely covers the base 100, such that the package box 10 is aesthetical as a whole. The cover body 200 further includes a first sub cover 210 and a second sub cover 220. The first sub cover 210 and the second sub cover 220 are respectively arranged on two opposite sides of the base 100 and configured to rotate relative to the base 100, such that the first sub cover 210 and the second sub cover 220 can rotate towards or away from each other. When the cover body 200 covers the accommodating slot 130, the first sub cover 210 and the second sub cover 220 are arranged side by side and cover the base 100 together. The first sub cover 210 and the second sub cover 220 in this embodiment have the same shape and constitute the cover body 200 together, that is, the cover body 200 is divided into two parts to form the first sub cover 210 and the second sub cover 220. As illustrated in FIG. 6, when the cover body 200 covers the accommodating slot 130, the first sub cover 210 and the second sub cover 220 are arranged side by side along a left-right direction, and the first sub cover 210 and the second sub cover 220 cover the accommodating slot 130 together. The first sub cover 210 is rotatably connected with a left side of the base 100, and the second sub cover 220 is rotatably connected with a right side of the base 100. When the package box 10 is to be opened, the first sub cover 210 rotates leftwards and the second sub cover 220 rotates rightwards. When the package box 10 is to be closed, the first sub cover 210 rotates rightwards and the second sub cover 220 rotates leftwards. When the package box 10 is in the closed state, a right side of the first sub cover 210 abuts with a left side of the second sub cover 220. In this way, the cover body 200 is divided into the first sub cover 210 and the second sub cover 220. When opening or closing the package box 10, a rotation amplitude of the cover body 200 can be reduced, so as to facilitate the opening and closing of the package box 10. Moreover, the design of the above package box 10 is aesthetical.

Figure 9:
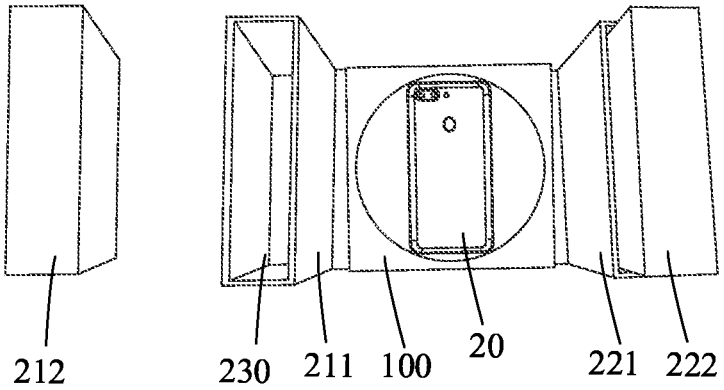
FIG. 9 is a schematic view of the package box illustrated in FIG. 8 in another state.

As illustrated in FIGS. 8 and 9, the first sub cover 210 includes a first shell 211 and a first drawer portion 212, the second sub cover 220 includes a second shell 221 and a second drawer portion 222, each of the first shell 211 and the second shell 221 defines a cavity therein, and each of the first shell 211 and the second shell 221 has an opening 230. The first drawer portion 212 may slide into or out of the cavity of the first shell 211 through the opening 230 of the first shell 211, and the second drawer portion 222 may slide into or out of the cavity of the second shell 221 through the opening 230 of the second shell 221. When the cover body 200 covers the accommodating slot 130, the opening 230 of the first shell and the opening 230 of the second shell are arranged right opposite to each other. In this case, the first sub cover 210 and the second sub cover 220 may function to cover the accommodating slot 130, and also may be configured to receive accessories of the mobile terminal 20, such as a charger, a headset, an instruction manual, etc., so as to facilitate the use of the package box 10. The first shell 211 and the second shell 221 are in a cuboid box shape. When the package box 10 is in the closed state, the opening 230 of the first shell 211 is arranged at the right side of the first shell 211, the opening 230 of the second shell 221 is arranged at the left side of the second shell 221, and the opening 230 of the first shell 211 and the opening 230 of the second shell 221 are arranged right opposite to each other, such that when the package box 10 is in the closed state, the first drawer portion 212 can be effectively prevented from sliding out of the first shell 211 and the second drawer portion 222 can be effectively prevented from sliding out of the second shell 221.

The package box 10 also includes a bottom plate 300, the base 100 is fixed on the bottom plate 300, the groove 120 is formed in a side of the base 100 which faces away from the bottom plate 300, and the first sub cover 210 and the second sub cover 220 are rotatably connected to two opposite sides of the bottom plate 300. The package box 10 includes four parts, namely the bottom plate 300, the first sub cover 210, the second sub cover 220 and the base 100. The first sub cover 210 and the second sub cover 220 are connected to left and right sides of the bottom plate 300, respectively, and can rotate relative to the bottom plate 300. The first shell 211 of the first sub cover 210 is directly connected to the bottom plate 300, and a fold is provided at the connection of the first shell 211 and the bottom plate 300, such that the first shell 211 can rotate relative to the bottom plate 300. Similarly, the second shell 221 and the bottom plate 300 may also be arranged as described above. Through the above arrangement, the manufacture of the package box 10 is convenient.

The present disclosure also provides an apparatus kit which includes a mobile terminal 20 and a package box 10. The mobile terminal 20 is arranged in the accommodating slot 130 of the base 100 of the package box 10.

The technical features of the above embodiments may be arbitrarily combined. In order to keep the description concise, not all possible combinations of the technical features in the above embodiments have been described. However, these combinations of the technical features should be regarded as the scope of the present disclosure as long as there is no contradiction.

The above examples only represent several embodiments of the present disclosure, and the descriptions thereof are relatively specific and detailed, which should not be construed as a limitation to the scope of the present disclosure. It should be pointed out that, for those skilled in the related art, a number of modifications and improvements may be made without departing from the concept of the present disclosure, which belong to a protection scope of the present disclosure. Therefore, the protection scope of the present disclosure shall be defined by the attached claims.

What is claimed is:

1. An accommodation structure configured for receiving a mobile terminal, the accommodation structure comprising a base, wherein the base is provided with a groove, the groove has a bottom provided with an accommodating slot for receiving the mobile terminal, the groove has a depth measured from top to bottom and increasing from an edge of the groove to a position where the accommodating slot is located, the accommodating slot has a depth measured from top to bottom and varying along a periphery of the accommodating slot, and the periphery of the accommodating slot has a minimum height at a position of a maximum depth of the groove, wherein rest of the bottom of the groove except the accommodating slot is part of a spherical surface.

2. The accommodation structure as claimed in claim 1, wherein the accommodating slot is defined by a bottom wall and a side wall arranged in a circumferential direction of the bottom wall, the side wall comprises a first side wall and a second side wall arranged opposite to each other, as well as a third side wall and a fourth side wall connected between the first side wall and the second side wall, the third side wall and the fourth side wall are arranged opposite to each other, the first side wall, the second side wall, the third side wall, the fourth side wall and the bottom wall define the accommodating slot, a maximum distance between the first side wall and the second side wall is less than a maximum distance between the third side wall and the fourth side wall, and the depth of the accommodating slot varies along the side wall, and has the minimum value at the first side wall and the second side wall.

3. The accommodation structure as claimed in claim 1, wherein an orthographic projection of the groove on a reference plane is a circle or a regular N-polygon, and an orthographic projection of the accommodating slot on the reference plane is a rectangle, in which the reference plane is a geometric plane perpendicular to a depth direction of the groove, and N is an integer greater than or equal to 3.

4. The accommodation structure as claimed in claim 3, wherein an orthographic projection of the base on the reference plane is a rectangle, and an edge of the base surrounds the groove.

5. The accommodation structure as claimed in claim 3, wherein a center of the orthographic projection of the groove on the reference plane, a center of the orthographic projection of the accommodating slot on the reference plane and a center of the orthographic projection of the base on the reference plane coincide with one another.

6. The accommodation structure as claimed in claim 1, wherein the depth of the groove gradually increases from the edge of the groove to the position where the accommodating slot is located.

7. The accommodation structure as claimed in claim 1, further comprising a cover body rotatably connected with a side of the base and configured to cover the accommodating slot.

8. The accommodation structure as claimed in claim 7, wherein an orthographic projection of the cover body is configured to coincide with an orthographic projection of the base on a geometric plane perpendicular to a depth direction of the groove when the cover body covers the accommodating slot.

9. The accommodation structure as claimed in claim 8, wherein the cover body comprises a first sub cover and a second sub cover, the first sub cover and the second sub cover are respectively arranged on two opposite sides of the base and configured to rotate relative to the base, the first sub cover and the second sub cover are configured to rotate towards or away from each other, and the first sub cover and the second sub cover are further configured to be arranged side by side and cover the base together when the cover body covers the accommodating slot.

10. The accommodation structure as claimed in claim 9, wherein the first sub cover comprises a first shell and a first drawer portion, the second sub cover comprises a second shell and a second drawer portion, each of the first shell and the second shell defines a cavity, each of the first shell and the second shell has an opening, the first drawer portion is configured to slide into or out of the cavity of the first shell through the opening of the first shell, the second drawer portion is configured to slide into or out of the cavity of the second shell through the opening of the second shell, and the opening of the first shell and the opening of the second shell are configured to be arranged right opposite to each other when the cover body covers the accommodating slot.

11. The accommodation structure as claimed in claim 9, further comprising a bottom plate, wherein the base is fixed on the bottom plate, the groove is formed in a side of the base facing away from the bottom plate, and the first sub cover and the second sub cover are rotatably connected to two opposite sides of the bottom plate, respectively.

12. An apparatus kit, comprising:

a mobile terminal; and an accommodation structure receiving the mobile terminal therein;

wherein the accommodation structure comprises a base, the base has a groove, the groove is provided with an accommodating slot in a bottom thereof, the mobile terminal is received in the accommodating slot, the groove has a depth measured from top to bottom and increasing from an edge of the groove to a position where the accommodating slot is located, and a peripheral part of the mobile terminal protrudes out of the accommodating slot at a position of a maximum depth of the groove, wherein the accommodation structure further comprises a cover body rotatably connected with a side of the base and configured to cover the accommodating slot, the cover body comprises a first sub cover and a second sub cover, the first sub cover and the second sub cover are respectively arranged on two opposite sides of the base and configured to rotate relative to the base, such that the first sub cover and the second sub cover are configured to rotate towards or away from each other, and the first sub cover and the second sub cover are configured to be arranged side by side and cover the base together when the cover body covers the accommodating slot.

13. The apparatus kit as claimed in claim 12, wherein the mobile terminal comprises a front surface and a rear surface facing away from each other, and a side peripheral surface connected between the front surface and the rear surface, the mobile terminal comprising a display screen, the display screen has a display area facing the front surface, and a part of the side peripheral surface protrudes out of the accommodating slot at the position of the maximum depth of the groove.

14. The apparatus kit as claimed in claim 13, wherein the accommodating slot is defined by a bottom wall and a side wall arranged in a circumferential direction of the bottom wall, the side wall comprises a first side wall and a second side wall arranged opposite to each other, and a third side wall and a fourth side wall connected between the first side wall and the second side wall, the third side wall and the fourth side wall are arranged opposite to each other, the first side wall, the second side wall, the third side wall, the fourth side wall and the bottom wall define the accommodating slot, a maximum distance between the first side wall and the second side wall is less than a maximum distance between the third side wall and the fourth side wall, and the part of the side peripheral surface is exposed out of the first side wall and the second side wall.

15. The apparatus kit as claimed in claim 12, wherein a thickness of the peripheral part of the mobile terminal protruding out of the accommodating slot at the position of the maximum depth of the groove is greater than or equal to ½ of a thickness of the mobile terminal.

16. The apparatus kit as claimed in claim 12, wherein the first sub cover comprises a first shell and a first drawer portion, the second sub cover comprises a second shell and a second drawer portion, each of the first shell and the second shell defines a cavity therein, each of the first shell and the second shell has an opening, the first drawer portion is configured to slide into or out of the cavity through the opening of the first shell, the second drawer portion is configured to slide into or out of the cavity through the opening of the second shell, and the opening of the first shell and the opening of the second shell are configured to be arranged right opposite to each other when the cover body covers the accommodating slot.

17. The apparatus kit as claimed in claim 12, wherein the accommodation structure further comprises a bottom plate, the base is fixed on the bottom plate, the groove is formed in a side of the base facing away from the bottom plate, and the first sub cover and the second sub cover are rotatably connected to two opposite sides of the bottom plate.

18. An accommodation structure for receiving a mobile terminal, the accommodation structure comprising a base, the base having a surface, the surface having a concave part recessed relative to rest of the surface, an accommodating slot being formed in the concave part and configured to receive the mobile terminal, wherein the concave part has a depth increasing from the rest of the surface to a peripheral wall of the accommodating slot, the peripheral wall of the accommodating slot has a varying height, and the peripheral wall of the accommodating slot has a minimum height at a position where the concave part has a maximum depth, wherein the accommodating slot is defined by a bottom wall and a side wall arranged in a circumferential direction of the bottom wall, the side wall is configured as the peripheral wall of the accommodating slot and comprises a first side wall and a second side wall arranged opposite to each other, as well as a third side wall and a fourth side wall connected between the first side wall and the second side wall, the third side wall and the fourth side wall are arranged opposite to each other, the first side wall, the second side wall, the third side wall, the fourth side wall and the bottom wall define the accommodating slot, a maximum distance between the first side wall and the second side wall is less than a maximum distance between the third side wall and the fourth side wall, and a depth of the accommodating slot varies along the side wall, and has a minimum value at the first side wall and the second side wall.

* * * * *